United States Patent [19]

Tellier

[11] Patent Number: 4,994,826

[45] Date of Patent: Feb. 19, 1991

[54] THERMAL INK JET PRINTHEAD WITH INCREASED OPERATING TEMPERATURE AND THERMAL EFFICIENCY

[75] Inventor: Thomas A. Tellier, Williamson, N.Y.

[73] Assignee: Xerox Corporation, Stamford, Conn.

[21] Appl. No.: 467,439

[22] Filed: Jan. 19, 1990

[51] Int. Cl.[5] ..... B41J 2/05

[52] U.S. Cl. ..... 346/140 R

[58] Field of Search ..... 346/140 R

[56] References Cited

U.S. PATENT DOCUMENTS

| | | | |
|---|---|---|---|
| Re. 32,572 | 1/1988 | Hawkins et al. | 156/626 |
| 4,463,359 | 7/1984 | Ayata et al. | 346/1.1 |
| 4,532,530 | 7/1985 | Hawkins | 346/140 R |
| 4,638,337 | 1/1987 | Torpey et al. | 346/140 R |
| 4,774,530 | 9/1988 | Hawkins | 346/140 R |
| 4,835,553 | 5/1989 | Torpey et al. | 346/140 R |

*Primary Examiner*—Bruce A. Reynolds
*Assistant Examiner*—Alrick Bobb

[57] ABSTRACT

An ink jet printhead for printing ink droplets on a recording medium on demand is disclosed, comprising an upper and lower substrate, each having at least one substantially flat surface. The substrate flat surfaces are mated and bonded together with a thick film layer sandwiched therebetween. The flat surface of the upper substrate contains a set of parallel, closed-end grooves for subseqeunt use as ink flow channels and a separate associated recess for subsequent use as an ink manifold for supplying ink to the saet of channels. The flat surace of the lower substrate having an array of heating elements and addressing electrodes formed thereon. The thick film layer is deposited on the surface of the lower substrate and over the heating elements and addressing electrodes and patterned, prior to the mating of the substrates, to remove predetermined portions of the thick film layer, thus forming an ink flow path in the thick film layer betwaeen the channels and the manifold and currently forming a set of individual, parallel trenches open at one end. The trenches expose each heating element and extend to the edge of the lower substrate to form the open end. After the substrates are mated, the open end of the trenches serve as droplet emitting nozzles and the closed ends serve as a back wall to prevent lateral bubble growth in that direction while the groove closed ends inhibit lateral bubble growth towards the nozzles and concurrently provides additional ink capacity above the heating elements.

4 Claims, 3 Drawing Sheets

THERMAL INK JET PRINTHEAD WITH INCREASED OPERATING TEMPERATURE AND THERMAL EFFICIENCY

BACKGROUND OF THE INVENTION

1. Field of the Invention

This invention relates to ink jet printing and more particularly to a thermal ink jet printhead having increased operating temperature, less fabricating tolerances, and more energy efficient heating elements enabled by ink channel geometry.

2. Description of the Prior Art

Thermal ink jet printing is a type of drop-on-demand ink jet printing which uses selectively applied thermal energy to expel ink droplets by producing momentary vapor bubbles in ink-filled channels of a printhead. A thermal energy generator, usually a resistor, is located in each of a plurality of channels near the nozzles at one end thereof. The other ends of the channels are in communication with a common manifold or reservoir which contains a source of ink.

U.S. Pat. No. 4,463,359 to Ayata et al, discloses one or more ink filled channels which are replenished by capillary action. A meniscus is formed at each nozzle to prevent ink from weeping therefrom. A resistor or heater is located in each channel upstream from the nozzles. Current pulses representative of data signals are applied to the resistors to momentarily vaporize the ink in contact therewith and form a bubble for each current pulse. Ink droplets are expelled from each nozzle by the growth and collapse of the bubbles. Current pulses are shaped to prevent the meniscus from breaking up and receding too far into the channels, after each droplet is expelled. Various embodiments of linear arrays of thermal ink jet devices are shown, such as those having staggered linear arrays attached tot he top and bottom of a heat sinking substrate and those having different colored inks for multiple colored printing.

U.S. Reissue Pat. Re. 32,572 to Hawkins, et al, discloses several fabricating processes for ink jet printheads, each printhead being composed of two parts aligned and bonded together. Many printheads can be simultaneously made by producing a plurality of sets of heating element arrays with their addressing electrodes on, for example, a silicon wafer and by placing alignment marks thereon at predetermined locations. A corresponding plurality of sets of channels and associated manifolds are produced in a second silicon wafer and in one embodiment alignment openings are etched thereon at predetermined locations. The two wafers are aligned via the alignment openings and alignment marks and then bonded together and diced into many separate printheads.

U.S. Pat. No. 4,638,337 to Torpey et al discloses an improved thermal ink jet printhead similar to that of Hawkins et al, but has each of its heating elements located in a recess. Recess walls containing the heating elements prevent the lateral movement of the bubbles through the nozzle and therefore the sudden release of vaporized ink to the atmosphere, known as blow-out, which causes ingestion of air and interrupts the printhead operation whenever this event occurs. In this patent, a thick film organic structure, such as Riston ®, is interposed between the heater plate and the channel plate. The purpose of this layer is to have recesses formed therein directly above each heating element to contain the bubbles generated by the heating element, enabling an increase in droplet velocity without the occurrence of vapor blow-out.

U.S Pat. No. 4,774,530 to Hawkins discloses an improved printhead which comprises an upper and lower substrate that are mated and bonded together with a thick insulative layer sandwiches therebetween. One surface of the upper substrate has etched therein one or more grooves and a recess, which when mated with the lower substrate, will serve as capillary filled ink channels and ink supplying manifold, respectively. Recesses are patterned in the thick layer to expose the heating elements to the ink, thus placing them in a pit and to provide a flow path for the ink from the manifold to the channels by enabling the ink to flow around the closed ends of the channels, thereby eliminating the fabrication steps required to open the groove closed ends to the manifold recess so that the printhead fabrication process is simplified.

U.S. Pat. No. 4,835,553 to Torpey et al discloses a printhead comprising upper and lower substrates that are mated and bonded together with a thick film insulative layer sandwiched therebetween. One surface of the upper substrate has etched therein one or more grooves and a recess which when mated with the lower substrate will serve as capillary filled ink channels and ink supply manifold, respectively. The grooves are open at one end and closed at the other. The open ends serve as nozzles. The manifold recess is adjacent the grooved closed ends. Each channel has a heating element located upstream of the nozzle. The heating elements are selectively addressable by input signals representing digitized data signals to produce ink vapor bubbles. The growth and collapse of the bubbles expel ink droplets from the nozzles and propel them to a recording medium. A recess with parallel extensions perpendicular thereto are patterned in the thick layer to provide a flow path for the ink from the manifold to the channels by enabling the ink to flow around the closed ends of the channels and the recess extensions increase the flow area to the heating elements. Thus, the heating elements lie at the distal end of the recess extensions, so that a vertical wall between the heating element and the nozzle prevents air ingestion while it increases the ink channel flow area and decreases refill time, resulting in an increase in bubble generation rate.

The above disclosed thermal ink jet printheads have a relatively long channel through which ink is supplied from the reservoir to the nozzle. The heating elements which produce the bubbles are placed in pits in the channel a predetermined distance upstream from the nozzle openings. The pits prevent bubble blow-out and the resultant ingestion of air, thus avoiding printhead failure. Unfortunately, for full area coverage, good droplet velocity, and around 4 kHz printing, the maximum operating temperature of the printhead without air ingestion is about 45° C. Clearly, a channel and heating element geometry which allows higher operating temperature is desired, and the present invention achieves this goal.

SUMMARY OF THE INVENTION

It is an object of the present invention to provide an ink jet printhead having a geometry that produces good droplet velocity and high droplet volume, while enabling increased operating temperature without losing its ability to prevent bubble blow-out with concomitant ingestion of air.

In the present invention, an ink jet printhead for printing ink droplets on a recording medium on demand is disclosed, comprising an upper and lower substrate, each having at least one substantially flat surface. The substrate flat surfaces are mated and bonded together with a thick film layer sandwiched therebetween. The flat surface of the upper substrate contains a set of parallel, closed-end grooves for subsequent use as ink flow channels and a separate associated recess for subsequent use as an ink manifold for supplying ink to the set of channels. The recess is adjacently located a predetermined distance from each end of one of the closed ends of the parallel grooves and has an opening in the bottom thereof for use as an ink inlet for the manifold. The flat surface of the lower substrate having an array of heating elements and addressing electrodes formed thereon, so that, after the substrates are mated and bonded, one heating element is located in each groove in the vicinity of the closed end opposite the one adjacent the manifold. The thick film layer is deposited on the surface of the lower substrate and over the heating elements and addressing electrodes and patterned, prior to the mating of the substrates, to remove predetermined portions of the thick film layer, thus forming an ink flow path in the thick film layer between the channels and the manifold and currently forming a set of individual, parallel trenches open at one end. The trenches expose each heating element and extend to the edge of the lower substrate to form the open end. After the substrates are mated, the open end of the trenches serve as droplet emitting nozzles, as well as ink flow passageways around the closed ends of the channels nearer the heating elements.

A more complete understanding of the present invention can be obtained by considering the following detailed description in conjunction with the accompanying drawings wherein like index numerals indicate like parts.

DESCRIPTION OF THE PREFERRED EMBODIMENT

Figure 1:
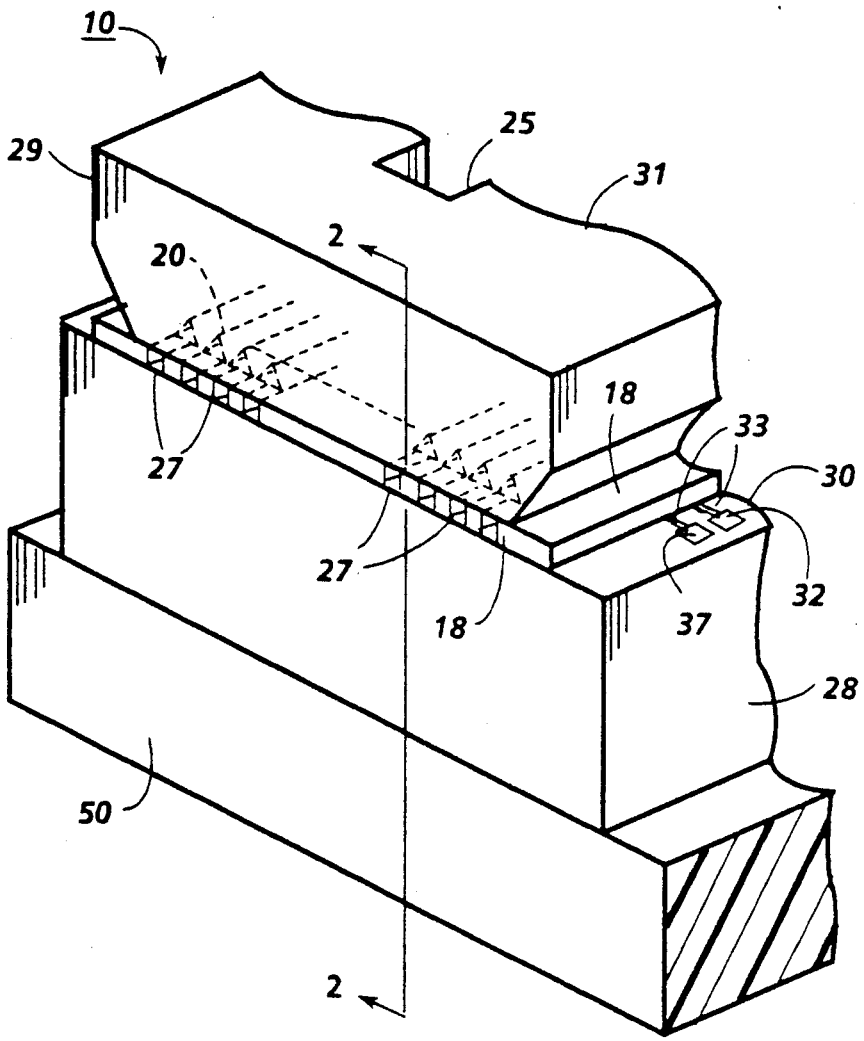
FIG. 1 is an enlarged schematic isometric view of a printhead mounted on a daughter board showing the droplet emitting nozzles and partial ink channels in dashed line.
Figure 2:
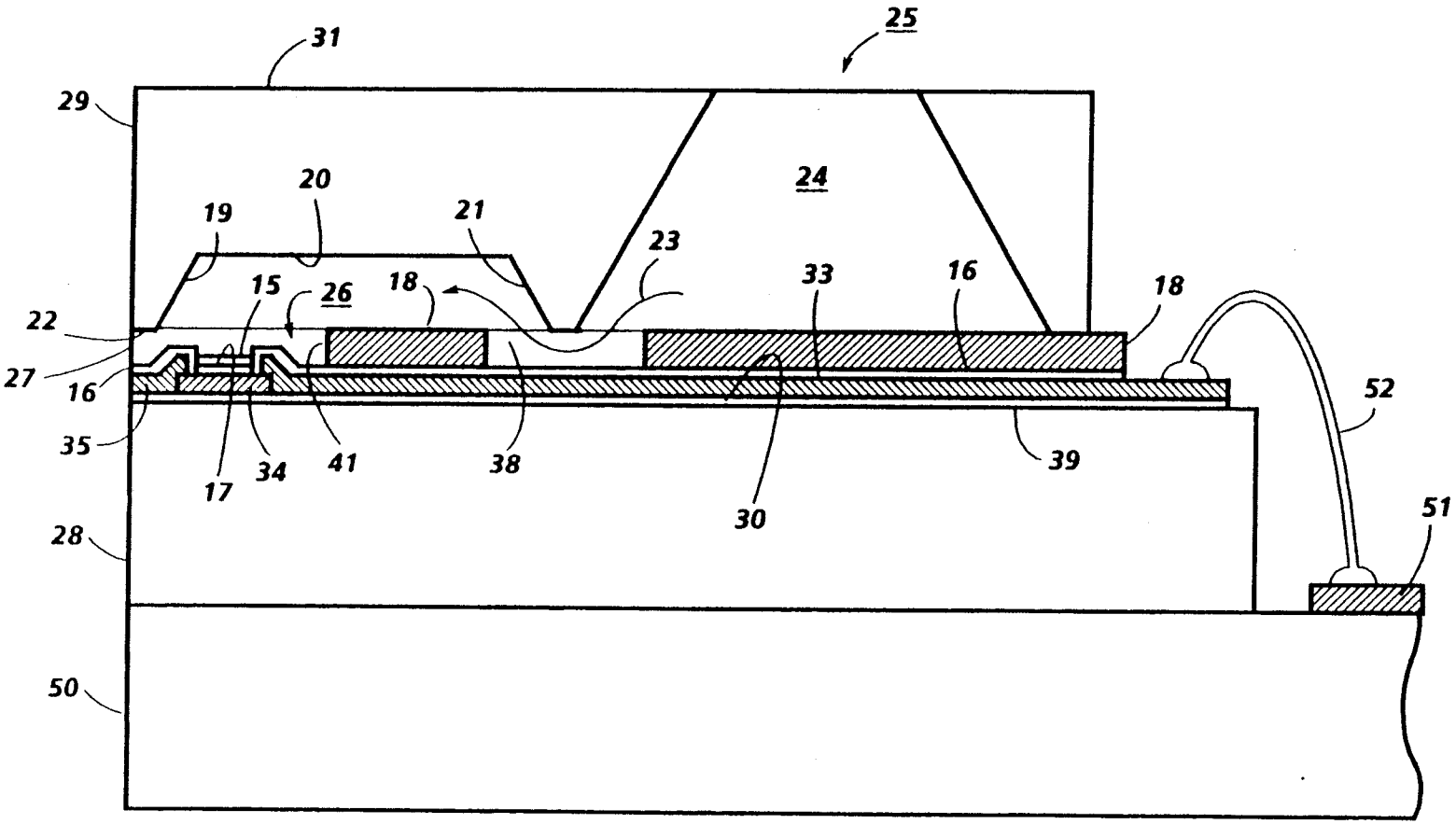
FIG. 2 is an enlarged cross sectional view of FIG. 1 as viewed along the view line 2—2 thereof and showing the electrode passivation and recessed thick film structure which provides the ink flow path between the manifold and ink channels and the nozzles for the printhead, and the ink flow path from the heating elements in the nozzles in accordance with the present invention.

An enlarged, partially shown schematic isometric view of the printhead 10, showing the array of droplet emitting nozzles 27 in the thick film layer 18 and coplanar with the front face 29 of channel plate 31, is depicted in FIG. 1. Referring also to FIG. 2, discussed later, the lower electrically insulating substrate or heating element plate 28 has the heating elements 34 and addressing electrodes 33 patterned on surface 30 thereof, while the upper substrate or channel plate 31 has parallel, closed-end grooves 20 which are perpendicular to the channel plate front face 29. The closed ends of the grooves adjacent the front face terminate with a slanted wall 19. The slanted wall 19 intersects channel plate surface 22 a predetermined distance from the front face. The other end of grooves terminate at slanted wall 21. The internal recess 24, which is used as the ink supply manifold or reservoir for the capillary filled ink channels 20, has an open bottom 25 for use an ink fill hole. The surface 22 of the channel plate with the grooves are aligned and bonded to a patterned, thick film layer, discussed later, deposited on the surface 30 of the heating element plate 28, s that a respective one of the plurality of heating elements 34 is aligned and positioned directly below the channel formed by the grooves and adjacent the closed end wall 19. Ink enters the manifold or reservoir formed by the recess 24 and the heating element plate 28 through the fill hole 25 and, by capillary action, fills the channels 20 by flowing through a common recess 28 formed in the thick film insulative layer 18, as depicted by arrows 23. An array of parallel trenches 26 are formed in the thick film layer which are closed on the upstream end 41 and open at the opposite end 27. The trenches are parallel and aligned with the grooves 20. The trench open end is coplanar with front face 29 and serves as the droplet emitting nozzles 27. In the vicinity immediately above the heating element 34, the end portion of the groove 20 having end well 19 provides a relatively large "domed" volume into which the momentary bubbles can expand to displace ink and eject an ink droplet. Thus, unlike the "no-pit" geometry of U.S. Re. 32,572, where the bubble can only expand laterally toward the nozzle, this invention offers increased vertical height into which the bubble can expand, a direction away from the nozzle. In addition, the groove slanted wall 19 assists in preventing ink vapor bubble blow-out and ingestion of air. The combined effect by the groove closed end or slanted wall 19 and closed end 41 of trench 26 is to inhibit lateral movement of the droplet ejecting bubble momentarily produced by electrical pulses sent through the heating elements via the addressing electrodes 33. The substantially instantaneous bubbles being produced to eject ink droplets are well known and described by the prior art discussed above.

The problem with the prior art pit, whether its geometry is as described in U.S. Pat. No. 4,638,337 or 4,835,553, is that it is difficult to simultaneously achieve large droplet volumes, high droplet velocity, and high operating temperatures (above which the ink vapor bubbles blow out and cause ingestion of air). The large droplet volumes are required to get complete fill in of the information printed on an ink receiving printing medium, such as paper, especially when the printing resolution is 300 spots per inch (spi). For nozzle area of about 800 to 1200 $\mu$m, the volumes should be in the range of 100–300 pico liters. The high droplet velocity is required to achieve good directionality, ad therefore the velocity should not be less than 5 meters/sec. Until the present invention, the highest operating temperature without periodic air ingestion for droplets having the appropriate volume and velocity is around 45° C. The geometry of the ink channel between the heating elements and the nozzles as shown in FIGS. 1 and 2 enable an operating temperature in the range of 65° to 75° C., a temperature of 20° C. to 30° C. above that available with prior art devices.

The ink at each nozzle forms a meniscus at a slight negative pressure, which prevents the ink from weeping therefrom. The addressing electrodes 33 on the channel plate 28 terminate at terminals or contact pads 32. The channel plate 31 is smaller than that of the lower substrate 28 in order that the electrode terminals 32 are exposed and available for connection of the electrodes on the daughter board 50 by, for example, wire bands 52 on which the printhead 10 is permanently mounted. Layer 18 is a thick film passivation layer, discussed later, sandwiches between upper and lower substrates. This layer is patterned to form the common recess 38 together with a plurality of separate elongated parallel trenches or troughs 26 extending from the nozzles to the upstream side of the heating elements. The heating elements, are placed at the bottom of the trough closed end. The common recess 38 enables ink flow between the manifold 24 and the channels 20, and the trench or trough 26 enables the flow of ink from the channel to the heating element in the trench. The open end of the trench serves as the nozzles 27. The slanted wall 19 of groove 20 and the upstream end wall 41 of the thick film insulative layer 18 combine to inhibit lateral movement of the temporary bubbles, so that bubble blowout and consequent ingestion of air is prevented when droplet velocities are maintained above 5 meters/sec. In addition, the thick film insulative layer is etched to expose the electrode terminals.

A cross sectional view of FIG. 1 is taken along view lien 2–2 through one channel and shown as FIG. 2 to show how the ink flows from the manifold 24 and around the closed end 21 of groove 20 as depicted by arrow 23. A plurality of sets of bubble generating heating elements 34 and their addressing electrodes 33 are patterned on the polished surface of a single side polished (100) silicon wafer. The polished surface of the water is coated with an underglaze layer 39, such as, silicon dioxide, having a thickness of about 1–2 micrometers prior to patterning of the resistive material that serves as the heating elements, the multiple sets of printhead electrodes 33, and the common return 35. The resistive material may be doped polycrystalline silicon which may be deposited by chemical vapor deposition (CVD) or any other well known resistive material such as zirconium boride ($ZrB_2$). The common return 35 and the addressing electrodes 33 are typically aluminum leads deposited on the underglaze and over the edges of the heating elements. The common return terminals 37 (see FIG. 1) and addressing electrode terminals 32 are positioned at predetermined locations to allow clearance for electrical connection to the electrodes 51 of the daughter board 50 by wire bonds 52, after the channel plate 31 is attached to the thick film layer 18 on the heating element plate to make a printhead. The common return 35 and the addressing electrodes 33 are deposited to a thickness of 0.5 to 3 micrometers, with the preferred thickness being 1.5 micrometers. For further details, refer to the patents discussed in the prior art section.

In the preferred embodiment, polysilicon heating elements are used and a silicon dioxide thermal oxide layer 17 is grown from the polysilicon in high temperature steam. For more details about the production of polysilicon heating elements, refer to U.S. Pat. No. 4,532,530 to Hawkins. The thermal oxide layer is typically grown to a thickness of 0.05 to 0.1 micrometer to protect and insulate the heating elements from the conductive ink. The thermal oxide is removed at the edges of the polysilicon heating elements for attachment of the of the addressing electrodes and common return, which are then patterned and deposited. Before electrode passivation, a tantalum (Ta) layer 15 may be optionally deposited to a thickness of about 1 micrometer on the heating element protective layer 17 for added protection thereof against the cavitational forces generated by the collapsing ink vapor bubbles during printhead operation. For electrode passivation, a two micrometer thick phosphorus doped CVD silicon dioxide film 16 is deposited over the entire wafer surface, including the plurality of sets of heating elements and addressing electrodes. The passivation film 16 provides an ion barrier which will protect the exposed electrodes from the ink. An effective ion barrier layer is achieved when its thickness is between 1000 angstrom and 10 micrometers, with the preferred thickness being 1 micrometer. The passivation layer 16 is etched off of the heating element or Ta layers and terminal ends of the common return and addressing electrodes for wire bonding later with the daughter board electrodes. This etching of the silicon dioxide film 16 may be by either the wet or dry etching method.

Next, a thick film type insulative layer 18 such as, for example, Riston ®, Vacrel ®, Probimer 52 ®, or polyimide, is formed on the passivation layer 16 having a thickness of between 5 and 100 micrometers and preferably in the range of 10 to 50 micrometers. The insulative layer 18 is photolithographically processed to enable etching and removal of those portions of the layer 18 necessary to form the sets of open-end trenches 26, each of which contain a heating element, and the common recess 38 providing ink passage from the ink manifold 24 to each of the ink channels 20. In addition, the thick film layer 18 is removed over each electrode terminal 32, 37. The plurality of the elongated open trenches 26 and associated common recess 38 for each set of heating elements on the wafer, which is to be subsequently divided into individual heating element plates 28, is formed by the removal of these portions of the thick film layer 18. Thus, the passivation layer 16 along protects the electrodes 33 from exposure to the ink in both the recess composed of a common recess 38 and the plurality of parallel elongated trenches 26. When the aligned and bonded wafers with intermediate thick film layer is diced into individual printheads, one of the dicing cuts concurrently forms the front face 29 and opens the trenches 26 to form nozzles 27.

One of the benefits of this invention is that the shape of the nozzles is determined by the thick film layer 18. The top and bottom surfaces of the nozzle are the confronting surfaces of the channel plate 31 and heating element plate 28, respectively. The sides of the nozzle are defined by the walls of the trenches 26 in the thick film layer 18 which generally lie between the ink channels 20. The trench walls 42 are optionally but preferably vertical. Thus, the nozzle shape is rectangular with a height determined by the height of the thick film layer, while the width of the nozzle is determined by the trench width or distance between trench walls 42 at its open end. Therefore, the nozzle geometry is easily changed for optimum operating parameters by varying the thickness and the trench pattern is the thick film layer. If desired, the nozzle cross-sectional area may be different from that of the trench nearer to the heating elements, i.e., the trench may neck down at the nozzle. Since the droplet volume is proportional to the nozzle area, the thick film layer 18 must have its thickness controlled from wafer-to-wafer by at least within ±5%.

Figure 3:
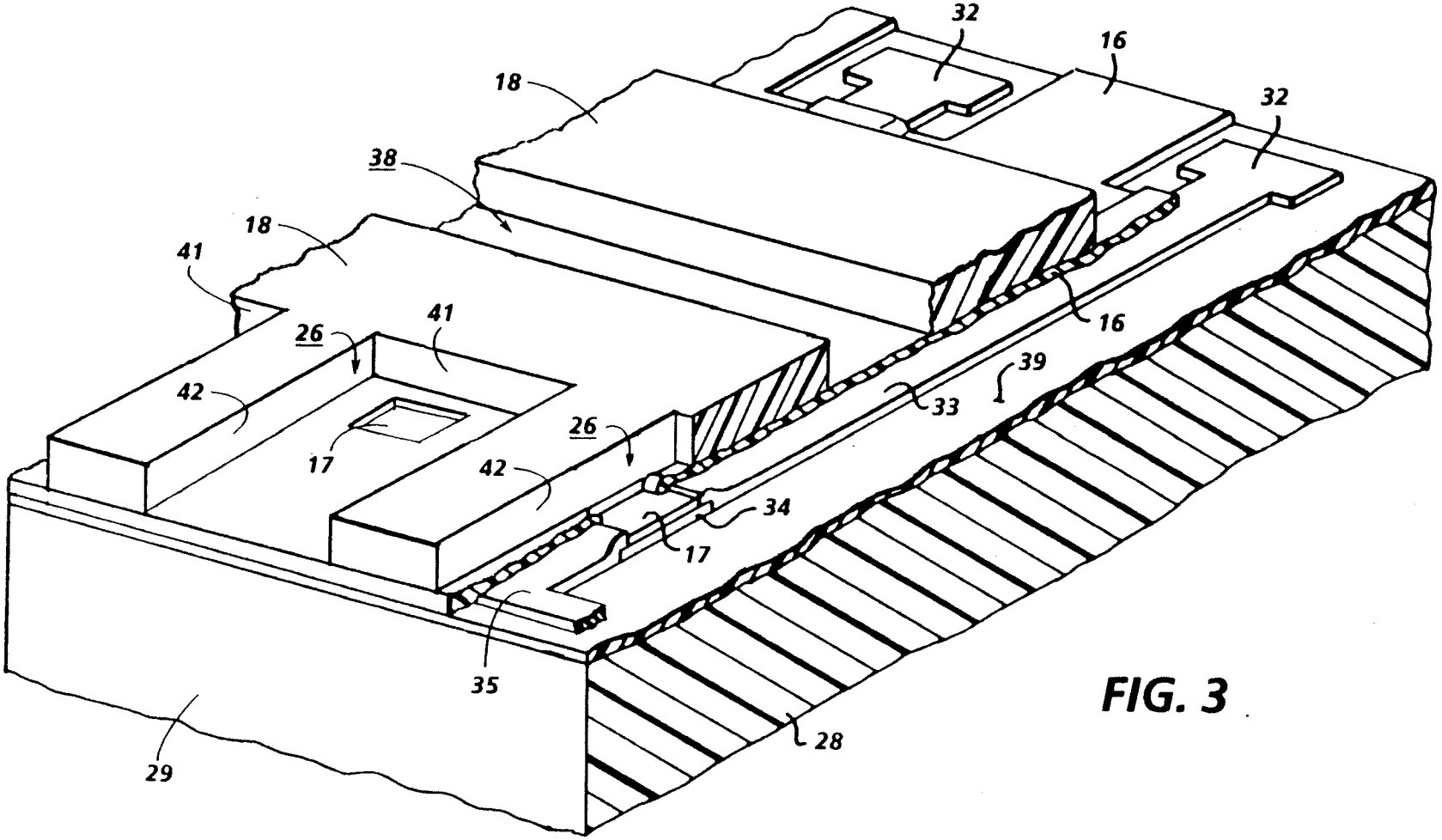
FIG. 3 is an enlarged partially shown isometric view of the heating element plate as viewed prior to mating with the channel plate to form the printhead. The heating element plate is partially sectioned to show the open-ended recesses which serve as nozzles and passageways around the channel closed ends.

In FIG. 3, an enlarged, partially sectioned isometric view of the heating element plate 28 is shown. Part of the electrode passivation layer 16 and the overlaying relatively thick insulating layer 18 (preferably Riston®, Vacrel®, polyimide, or equivalent) is removed from a portion of one addressing electrode for ease of understanding the improved nozzle construction and nozzle to heating element geometry. Each layer 18 is photolithographically patterned and etched to remove it from the electrode terminals 32, 37, the common recess 28, and an elongated area 26 beginning upstream of each heating element 34 and its protective layer 17 and extending through the front face 29, so that a trench 26 is formed with an open end that serves as a nozzle. In the preferred embodiment, the distance between the upstream trench wall 41 and the heating elements is about 12 μm but may be varied to optimize the operating parameters. The common recess 38 is located at a predetermined position to permit ink flow from the manifold to the channels, after the channel plate 31 is mated thereto. The closed end of the trenches 26 contain each heating element and provide an ink flow path around the slanted wall 19 of groove 20 to the trench 26 and its open end or nozzle 27. The closed end wall 41 of the trench 26 inhibits lateral movement of each bubble generated by the pulsed heating element toward the reservoir 24 and thus promotes bubble growth in a direction normal thereto, while the above groove 20 provides both adequate ink flow area, vertical height for bubble growth normal to the heating elements, and refill time during the printhead operation. The blowout phenomena of releasing a burst of vaporized ink with consequent ingestion of air is avoided by the groove slanted wall 19 which provides the similar function as the thick film wall 42 in U.S. Pat. No. 4,835,553. The frequency of droplet expulsion remains essentially the same as that of the pit configuration and may be optimized by turning the channel widths and lengths as is well known in the art.

As disclosed in U.S. Reissue Pat. Re. 32,572; U.S. 4,638,337; and U.S. Pat. No. 4,774,530, the channel plate 31 is formed from a two-side-polished, (100) silicon wafer (not shown) to produce a plurality of upper substrates or channel plates 31 for the printhead 10. After the wafer is chemically cleaned, a pyrolytic CVD silicon nitrite layer (not shown) is deposited on both sides. Using conventional photolithography, at least two vias for alignment openings (not shown) at predetermined locations are printed on one wafer side. The silicon nitride is plasma etched off of the patterned vias representing the alignment openings. A potassium hydroxide (KOH) anistropic etch may be used to etch the alignment openings. In this case, the {111□ lanes of the (100) wafer make an angle of 54.7 degrees with the surface of the water. The alignment openings are about 60 to 80 mils (1.5 to 2 mm) square, and are etched entirely through the 20 mil (0.5mm) thick wafer. Alternatively, an infra red aligner may be used to align the channel and heating element wafers.

Next, the opposite side of the wafer is photolithographically patterned, using the previously etched alignment holes as a reference to form the relatively large rectangular recesses 24 with an open bottom 25 and sets of elongated, parallel channel recesses 20 that will eventually become the ink manifolds and channels of the printheads. The surface 22 of the wafer (and channel plate) containing the manifold and channel recesses are portions of the original wafer surface (covered by a silicon nitride layer) on which adhesive will be applied later for bonding it to the substrate containing the plurality of sets of heating elements. A final dicing cut, which produces end face 29, opens one end of the thick film trench 26 by producing nozzles 27. The ends of the channel groove 20 remain closed by slanted walls 19 and 21. However, the alignment and bonding of the channel plate to the heater plate places the ends 21 of channels 20 directly over common recess 38 in the thick film insulative layer 18 and slanted ends 19 over trenches 26 in the thick film insulative layer between the heating elements 34 and nozzles 27, as shown in FIG. 2, enabling the flow of ink into the channels from the manifold as depicted by arrows 23 and from the channels to the nozzles via trenches 26.

This invention provides an elongated ink channel 20 from an anisotropic etching of a groove 20 in the surface of a (100) silicon wafer. The groove is triangular shaped in cross section and has its ends closed by slanted walls 19, 21. Egress and ingress by the ink into the groove is by recesses 26, 38 in the thick film layer 18. The groove terminates with slanted wall 19 directly upstream of the heating element 34. Trenches 26, one for each groove or channel 20, expose the heating elements and provide the flow path for the ink from he channel to the heating element and to the nozzle 27. The nozzle is provided by the open end of the trench 26, the trench being opened by the dicing operation to cut the aligned and bonded wafers (not shown) and photopatterned thick film layer 18 sandwiched therebetween into individual printheads in a manner similar to that disclosed in U.S. Pat. Nos. 4,774,530 and 4,835,553 incorporated herein by reference. Thus, the pit and step geometry of the prior art are eliminated and instead the air ingestion is prevented by closed end (wall 19) of the channel above the heating element in combination with the back wall 41 of the open trench 26, while providing increased operating temperature. The ink volume above the heater is enlarged by the combination of trench 26 and groove 20 to enable vertical expansion of the droplet expelling bubble, as well as to increase the cross sectional flow area and minimize the flow resistance.

In addition to the obvious benefit of increased operating temperature for a printing device requiring heat control management, the printhead of the present invention has the additional benefits of increased droplet size enabled by the enlarged volume above the heating element, the blocking end wall 19 above the nozzle, trench wall 41, and the location of the nozzle substantially on the same plane as the heating elements. Tests conducted with the nozzle geometry of the present invention showed unusually high operating temperatures without air ingestion (greater than 65° C.), while at the same time produced droplets having enlarged volumes (up to 250 pico liters). The increased operating temperature latitude permits a reduction of the heating element area, so that the printhead becomes more efficient.

Many modifications and variations are apparent from the foregoing description of the invention, and all such modifications and variations are intended to be within the scope of the present invention.

I claim:

1. A method of thermally ejecting ink droplets from a printhead on demand and printing the droplets on a recording medium, the printhead having an array of nozzles and a refillable, ink-supplying reservoir, with an array of parallel, ink-flow directing channels therebetween, the method comprising the steps of:

(a) supplying ink to bubble generating regions in each of channels from the reservoir under a slight negative pressure to prevent weeping of the ink from the nozzles, the channels being in communication with the reservoir at one end and having said nozzles at the other end, the nozzles having a predetermined vertical opening height, the bubble generating regions each having a heating element therein located a predetermined distance upstream of the nozzles and having an ink containing cavity located directly over the heating elements and above the nozzles;

(b) providing a back wall upstream of the heating elements with a height equal to the nozzle vertical opening height, said back wall and nozzle vertical opening height being substantially perpendicular to the heating element and extending from a plane containing the heating elements; and (c) applying electrical pulses to heating elements in the bubble generating regions of the channels to temporarily form droplet ejecting bubbles in the ink in contact with said heating elements, said back wall and cavity cooperatively functioning to prevent lateral expansion of the bubble, while the cavity concurrently provides additional height and ink capacity above the nozzles, thus promoting extended vertical bubble growth, so that larger droplets are ejected with appropriate velocity without ingestion of air at higher operating printhead temperatures.

2. An ink jet printhead for thermally ejecting and propelling ink droplets from a printhead on demand toward a recording medium for printing thereon, the printhead having an array of nozzles, a refillable ink reservoir, and an array of parallel, ink flow directing channels providing communication between the nozzles and reservoir, the printhead comprising:

means to supply ink to the printhead reservoir under a slightly negative pressure;

each channel having a bubble generating region with a flat surfaced heating element therein a predetermined distance upstream of the nozzles, a back wall upstream of the heating element, and a cavity located directly over the heating elements, the nozzles having a predetermined vertical opening height and said back wall having a height equal tot he nozzle opening height, the back wall and nozzle opening being substantially perpendicular to and on opposite sides of the heating elements and extending from a plane containing the heating elements with the cavity located above the nozzles and back walls; and means for selectively applying electrical pulses to the heating elements to form temporary vapor bubbles in the ink in contact therewith, said back wall and cavity cooperatively functioning to prevent lateral expansion of the bubble in a direction parallel to the heating element surfaces, while the cavity concurrently provides additional height and ink capacity above the heating elements, so that vertical bubble growth is promoted thereby enabling ejection of larger droplets at higher operating temperatures without reducing the droplet velocity or ingestion of air.

3. An ink jet printhead for printing ink droplets on a recording medium on demand, comprising:

an upper and lower substrate, each having at least one substantially flat surface, the substrate flat surfaces being mated and bonded together with a thick film layer sandwiched therebetween;

the flat surface of the upper substrate having formed therein a set of parallel, closed-end grooves for subsequent use as ink flow channels and a separate associated recess for subsequent use as an ink manifold for supplying ink to the set of channels, the recess being adjacently located a predetermined distance from one of the closed ends of the set of parallel grooves and having an opening in the bottom thereof for use as an ink inlet for the manifold;

the flat surface of the lower substrate having an array of heating elements and addressing electrodes formed thereon, so that, after the substrates are mated and bonded, one heating element is located directly below each groove in the vicinity of the closed end opposite the one adjacent the manifold;

the thick film layer being deposited on the surface of the lower substrate and over the heating elements and addressing electrodes and patterned, prior to the mating of the substrates, to remove predetermined portions of the thick film layer, thus forming an elongated ink flow path in the thick film layer perpendicular to the channels between the channels and the manifold and currently forming a set of individual, parallel trenches open at one end, the trenches beginning over and exposing each heating element and extending to the edge of the lower substrate to form the open end, so that, after the substrates are mated, the open end of the trenches serve as droplet emitting nozzles, as well as ink flow passageways around the closed ends of the channels nearer the heating elements, the closed end of the channel adjacent the nozzle and the closed end of the a trenches functioning to inhibit lateral growth of the bubble and prevent air ingestion during operation of the printhead and enabling both a higher operating printhead temperature and more energy efficient heating elements.

4. The printhead of claim 3, wherein each trench closed end is a wall located a predetermined distance upstream of the heating elements and has the same height as nozzle, so that the closed end of the upper substrate groove is located above the nozzles and provides a raised domed space promoting vertical bubble growth increasing ink volume above the heating elements that enables larger droplets.

* * * * *